US005199620A

United States Patent [19]

Beletsky

[11] Patent Number: 5,199,620

[45] Date of Patent: Apr. 6, 1993

[54] SECURITY HOLSTER THUMB-BREAK

[75] Inventor: Robert J. Beletsky, Rockport, Mass.

[73] Assignee: Strong Holster Company, Gloucester, Mass.

[21] Appl. No.: 730,030

[22] Filed: Jul. 12, 1991

Related U.S. Application Data

[63] Continuation of Ser. No. 464,367, Jan. 12, 1990, abandoned, which is a continuation-in-part of Ser. No. 420,144, Oct. 11, 1989, abandoned.

[51] Int. Cl.[5] ..... F41C 33/02

[52] U.S. Cl. ..... 224/243; 224/911

[58] Field of Search ..... 224/243, 244, 911, 246, 224/242; 24/589, 591, 663, 590, 597, 649, 701, 589, 697

[56] References Cited

U.S. PATENT DOCUMENTS

| | | | |
|---|---|---|---|
| Re. 30,139 | 11/1979 | Jones | 224/243 |
| 4,286,741 | 9/1981 | Rogers | 224/243 |
| 4,378,082 | 3/1983 | Chica | 224/243 |
| 4,750,655 | 6/1988 | Barry | 224/243 |
| 4,886,197 | 12/1989 | Bowles | 224/243 |

*Primary Examiner*—Linda J. Sholl
*Attorney, Agent, or Firm*—Brian M. Dingman

[57] ABSTRACT

An assembly for releasably securing a holster safety strap including a device for fastening the safety strap to the holster, a securing device on one of the safety strap and the holster, and a fastener on the other of the safety strap and the holster rotatable between a first, unlocking position and a second, securing position, the fastener in the second position engaged with the securing device to inhibit operation of the releasable fastener and in the first position disengaged from the securing device to allow normal operation of the releasable fastener for providing additional securing in a holster safety strap.

13 Claims, 6 Drawing Sheets

SECURITY HOLSTER THUMB-BREAK

RELATED APPLICATIONS

This is a continuation of application Ser. No. 07/464,367, filed Jan. 12, 1990 now abandoned which is a continuation-in-part of copending application Ser. No. 07/420,144 filed Oct. 11, 1989, abandoned.

FIELD OF INVENTION

This invention relates to a security holster and more particularly to an improved thumb-break style holster in which the thumb-break is the secondary restraint.

BACKGROUND OF INVENTION

Holster designs have evolved quickly in recent years due to safety concerns for the wearer. The first holsters were simply open pouches in which the handgun could be withdrawn in a single motion. These open pouch designs had no means of securing the handgun in the holster to prevent inadvertent or adversarial withdrawal. In response to concerns for wearer safety, holsters with a single security device were developed. Typically, the security device included a strap spanning the open holster pouch and provisionally secured to the holster with a snap. The strap prevented withdrawal of the gun until unsnapped.

A more advanced form of this single security holster design is the common thumb-break holster in which the strap is snapped to the raised inside top edge of the holster, which takes the form of a tab extending from the pouch. This allows the snap to be unfastened with the wearer's thumb to provide quick and easy access to the handgun. However, the thumb-break would also be opened just as easily by an adversary, who could simply reach in from behind the wearer, unsnap the strap and withdraw the gun from the rear.

In recent years there have been many attempts to provide additional security in thumb-break style holsters for preventing unwanted handgun withdrawal. These holster designs have typically added a second level of security which inhibits in some manner handgun withdrawal after the strap is opened. Most designs have added as a second level of security some form of holster tension to inhibit gun withdrawal. In one solution, a strap was added across the rear of the pouch opening to cover the revolver trigger guard. This prevents the gun from being withdrawn from the rear. The front of the pouch is then slit to allow the gun to be pushed forward and out and up through the front section of the holster. Typically, a spring member is sewn into the pouch surrounding the slit to provide a tension which must be overcome to withdraw the gun.

The advantage of this holster design was that the gun had to be pushed forward and up to be removed; an adversary had to be standing in front of the wearer to remove the gun, which allowed the wearer additional time to react. However, these holsters suffer from a number of drawbacks which have prevented them from being universally accepted as providing sufficient security. First, the thumb-break is the only actual positive security device. The secondary security device is simply the holster spring tension in combination with the requirement of forward gun motion. Thus, once the primary device is defected, there is a possibility of inadvertent gun withdrawal. Another drawback is the requirement of providing holster tension. Typically, holsters are leather and the tension is provided by sewing a strong spring into the pouch. However, this requires much additional expense and labor in manufacturing the holster. Also, the springs are typically quite stiff when new and must be worked in until they have enough give to allow the wearer to withdraw the gun in a comfortable fashion. As the holster is used, the spring continues to wear, providing less and less security. In relying on spring tension as the secondary device, these holsters will eventually wear and have to be replaced.

Another problem the spring tension thumb-break holsters is that the holster must typically be worn so the pouch is vertical to allow the wearer to relatively easily remove the gun with the forward and up movement required. However, the Federal Bureau of Investigation has determined after much study that a slight forward holster cant or rake of approximately thirteen degrees from vertical is the ideal holster position, primarily to ensure that the wearer leans forward into a crouching position as the gun is drawn, and also for deterring withdrawal from the rear. With the spring tension thumb-break holster, if the pouch is raked or canted forward, the forward and up removal motion becomes awkward and difficult to accomplish quickly; the forward motion would become almost a downward motion which would be clumsy and could potentially lead to situations in which the handgun could not be withdrawn quickly enough. Thus, those holsters can be worn in the safest and most secure manner.

Another problem with the spring tension thumb-break style holsters has been created by the recent tread of security forces carrying semi-automatic pistols. Typically, the semi-automatics have a flat trigger guard which can not be held in place with the trigger guard strap used in revolves holsters. One solution to this problem has been to employ a protruding member built into the holster pocket positioned to rest inside the trigger guard when the pistol is placed in the holster. The protruding member is positioned to prevent vertical or rearward withdrawal; the handgun must be pushed forward and up to withdraw, much as in the handgun holsters. However, the protruding member adds greatly to the complexity of the holster and may also be a security hazard, as it rests inside of the trigger guard. By having a protruding member adjacent the trigger, there is always the possibility that the gun could be jostled enough to press the trigger against the protruding member and fire the gun while in the holster. Thus, there exists a need for more secure double security thumb-break style holster for semi-automatic pistols.

SUMMARY OF INVENTION

It is therefore an object of this invention to provide an improved thumb-break holster which includes two distinct levels of positive restraint.

It is a further object of this invention to provide such a holster in which the thumb-break is the second level of restraint.

It is a further object of this invention to provide such a holster in which the primary means of restraint is a positive locking restraint.

It is a further object of this invention to provide such a holster which may be used for both revolvers and semi-automatic pistols.

It is a further object of this invention to provide such a holster which does not require a holster tension device.

It is a further object of this invention to provide such a holster which is not subjected to great stress on handgun withdrawal.

It is a further object of this invention to provide such a holster which is relatively simple and inexpensive to manufacture.

It is a further object of this invention to provide such a holster which allows the holster pouch to be raked forward.

It is a further object of this invention to provide such a holster in which the pouch is relatively light weight.

It is a further object of this invention to provide such a holster in which handgun removal requires removal action in two axes to inhibit inadvertent or unwanted withdrawal.

It is a further object of this invention to provide such a holster in which the releasable safety strap is more positively held in place.

It is a further object of this invention to provide such a holster in which the safety strap is fastened with a locking device.

This invention results from the realization that thumb-break style holsters can be dramatically improved by providing a primary restraint which must be opened with a motion in one axis to allow the thumb-break to be opened with a motion in a second axis.

This invention features an assembly for releasably securing a holster safety strap including means for releasably fastening the safety strap to the holster, securing means on one of the safety strap and the holster, and fastener means on the other of the safety strap and the holster. The fastener means is rotatable between a first, unlocking position and a second, securing position. The fastener means in the second position is engaged with the securing means to inhibit operation of the means for releasably fastening and in the first position disengaged from the securing means to allow normal operation of the means for releasably fastening for providing additional security in a holster safety strap. Preferably, the securing means and the fastener means are integral with the means for releasably fastening.

In a preferred embodiment, the securing means and the fastener means each include at least one and preferably two protruding tongue members adapted to engage with one another when the fastener means is in the second position. The fastener means is preferably attached to the holster.

The fastener means preferably pivots on a pivot axis transverse to the holster. The tongue members are preferably on opposite sides of the pivot axis and disposed in different directions for rotating engagement with the securing means tongue members.

In an alternative embodiment, the assembly includes a snap fastener assembly on the holster and safety strap adapted to releasably engage to provisionally attach the strap to the holster. Further included are a pair of fixed, spaced, substantially oppositely facing strap tongue members protruding from the strap facing the holster and a pair of spaced, relatively fixed, substantially oppositely facing holster tongue members rotatably attached to the holster facing the strap. The holster tongue members are rotatable from a first, unlocking position not engaged with the strap tongue members to a second, securing position engaged with the strap tongue members to hold together the strap and holster and prevent the snap fastener assembly from disengaging to provide additional securing in a holster safety strap.

DISCLOSURE OF PREFERRED EMBODIMENT

Other objects, features and advantages will occur to one skilled in the art from the following description of preferred embodiment and the accompanying drawings in which.

This invention may be accomplished in a security thumb-break holster with two restraints; the first released by a movement in one direction, and the second being a thumb-break released by movement in a second direction.

Figure 1A:
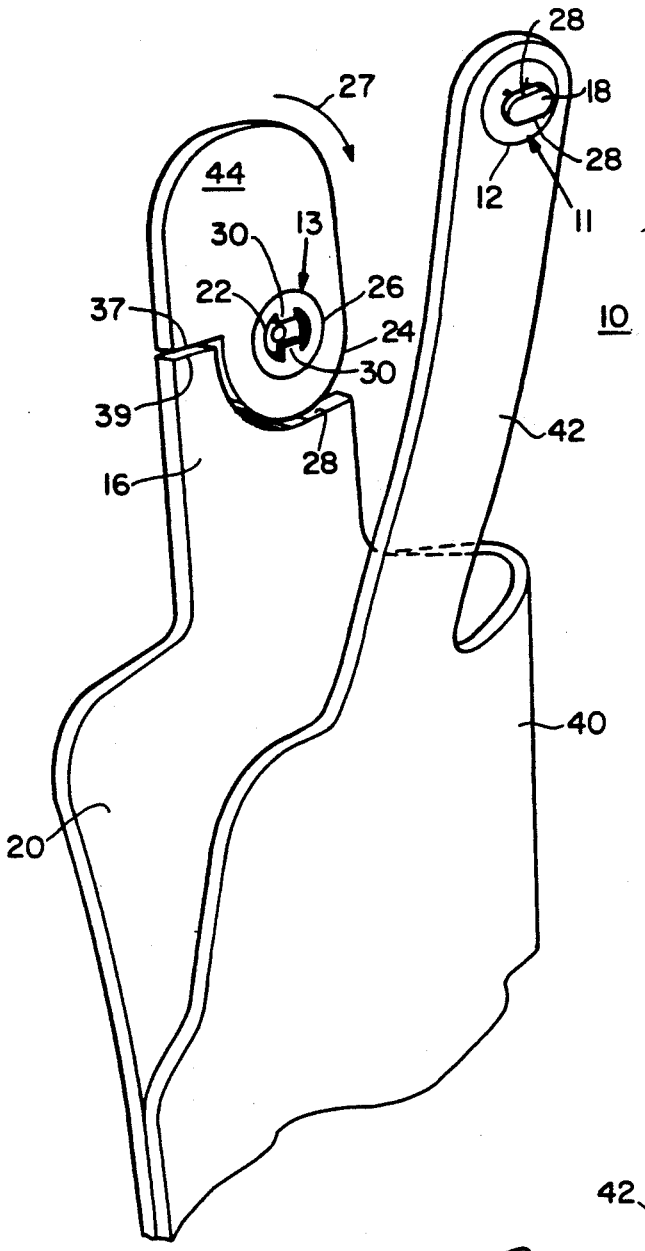
FIG. 1A is an axonometric view of a security thumb-break according to this invention on an open-top holster.

There is shown in FIG. 1A security thumb-break 10 according to this invention, mounted on open pouch 40 with rear opening 20 for accommodating the handgun trigger guard. Safety strap 42 is shown in the opened or unfastened position. In the ready position, with a single restraint in place, strap 42 is folded over across the opening in pouch 40, and protruding snap member 11 engages receiving snap member 13. Snap member 11 includes eyelet 12 and protruding stud 18 with flats 28 on its enlarged distal end. Snap member 13 includes socket member 26 with receiving socket 22 for receiving stud 18. Socket 22 includes inwardly-protruding tab members 30 which align with flats 28 in the position shown.

Rotating pivot member 44 is attached to holster section 16 and pivots forward on socket 22 in the direction of arrow 26. In use, strap 42 is folded over the gun, not shown, and snap member 11 fitted into snap member 13. Pivot member 44 is then pivoted forward 90° in the direction of arrow 26, at which point forward section 24 contacts holster section 28 to provide a positive stop for pivot member 44. In the pivoted or double-restraint position, protruding members 30 rest under the protruding lobes between flats 28 of stud 18, as is more fully described below, for preventing the snap from being unfastened. To release the handgun, pivot member 44 is pivoted back to the vertical position at which point the holster becomes the equivalent of a typical thumb-break style holster. Portion 37 contacts portion 39 to define the ready or single-restraint position. Thus, the rotating security snap assembly provides an additional positive security or restraint measure which must be unsecured before the thumb-break is even operational.

This forward-rotating snap-restraint assembly inhibits withdrawal of the gun from the rear, as pivot member 44 is facing forward in the double-restraint position. Security is also provided by the two-step, two-axis movement required to unfasten strap 42 from member 44; the backward rotation al and then unsnapping action requires two distinct movement which are less like to inadvertently occur than the single unsnapping action of the typical thumb-break holsters.

It should be understood that it is not necessary to include two flats and tabs as illustrated; one would suffice to prevent snap disengagement in at least one direction when the security device is rotated. In such an arrangement, a second security device, such as those described below, could be employed to prevent disengagement from any direction in the double-security position. It should also be understood that there are numerous other devices which could be employed to accomplish the pivoting security device for a thumb-break style holster according to this invention; several of those alternative devices are discussed below.

Security thumb-break 10 also allows pocket 40 to be made as a simple pouch; there is no need for the front opening surrounded by a spring member as is employed in the existing thumb-break security holsters. In addition, there is no need for the rear trigger guard strap found in those security holsters. As a result, holster 10 is extremely simple and inexpensive to manufacture while providing more positive security than exists in current holster designs.

Figure 1B:
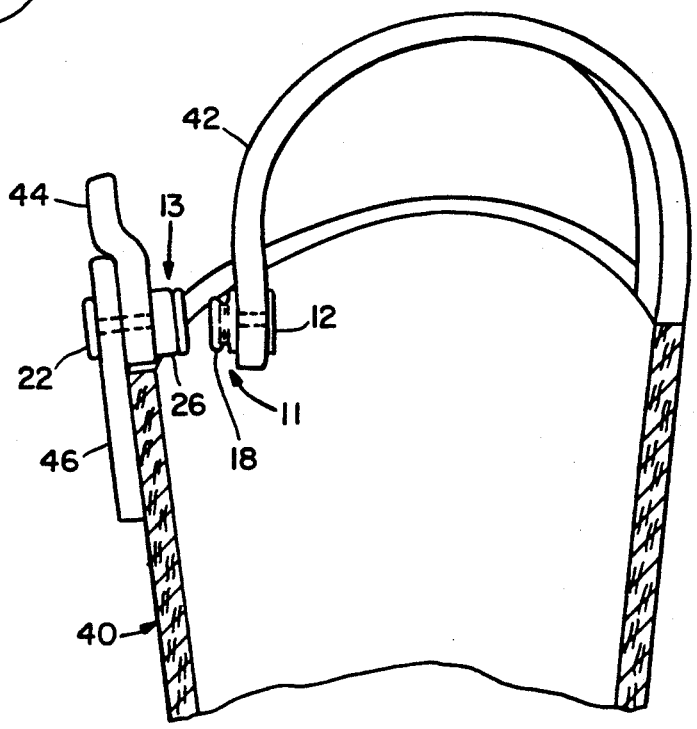
FIG. 1B is rear elevational partly cross-sectional view of the holster of FIG. 1A.

The snap member of the security device according to this invention is shown in more detail in FIG. 1B. Socket 26 accepts the distal end of stud 18, secured to strap 42 by eyelet 12. Similarly, eyelet 22 secures socket 26 to rotating member 44, which pivots on eyelet 22. Protruding holster portion 46 provides a means of securing eyelet 22 to holster 40 for allowing member 44 to pivot thereon.

Figure 1C:
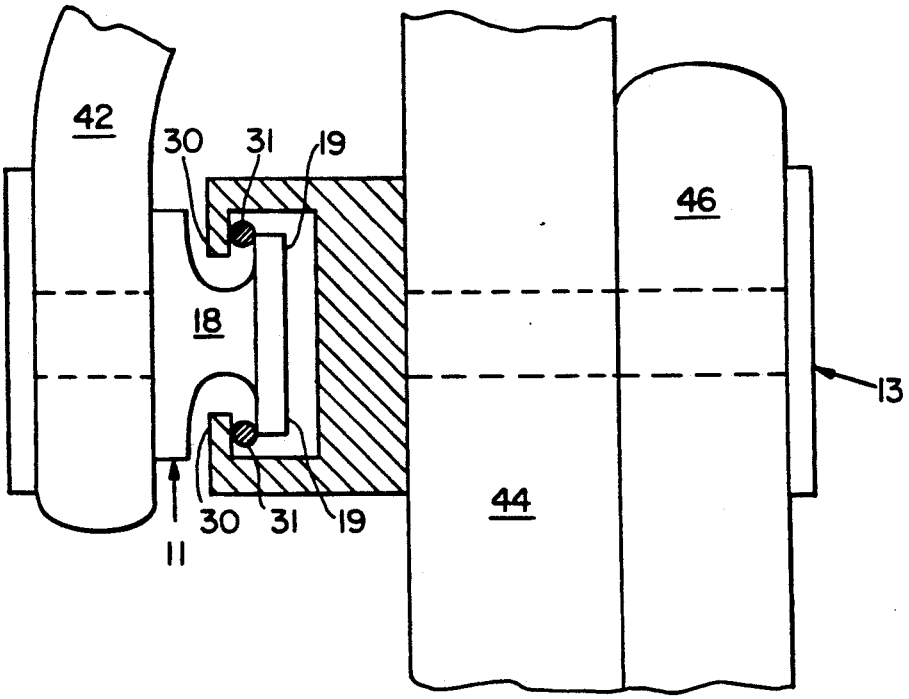
FIG. 1C is a greatly enlarged, schematic, partly cross-sectional diagram of the security snap of the holster of FIG. 1A in the secure position.
Figure 1D:
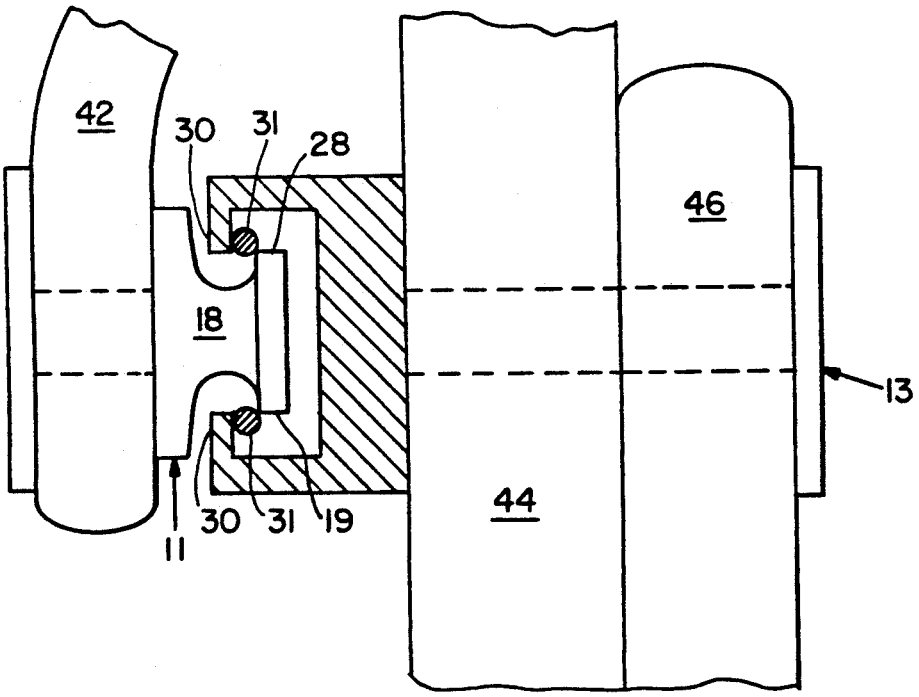
FIG. 1D is a greatly enlarged, schematic diagram of the snap of FIG. 1C in the ready position.

The releasable security feature of assembly of FIG. 1B is shown in more detail in FIGS. 1C and 1D, which depict the device in the double-restraint and ready positions, respectively. In the double-restraint position, FIG. 1C, protruding tabs 30 protrude under protruding lobes 19 of stud 18 to prevent the snap from being disengaged. Snap ring 31, in cross-section, is fitted under rim 30 of socket 26 as it is known in the art. FIG. 1D shows the snap in the ready or unsecured position in which stud flats 28 are aligned with protruding tabs 30 to allow snap members to be disengaged; in this position, after the primary security device has been disengaged, the holster is the equivalent of a typical thumb-break style holster, where snap-ring 31 is the only structure preventing the snap from disengaging.

Figure 1E:
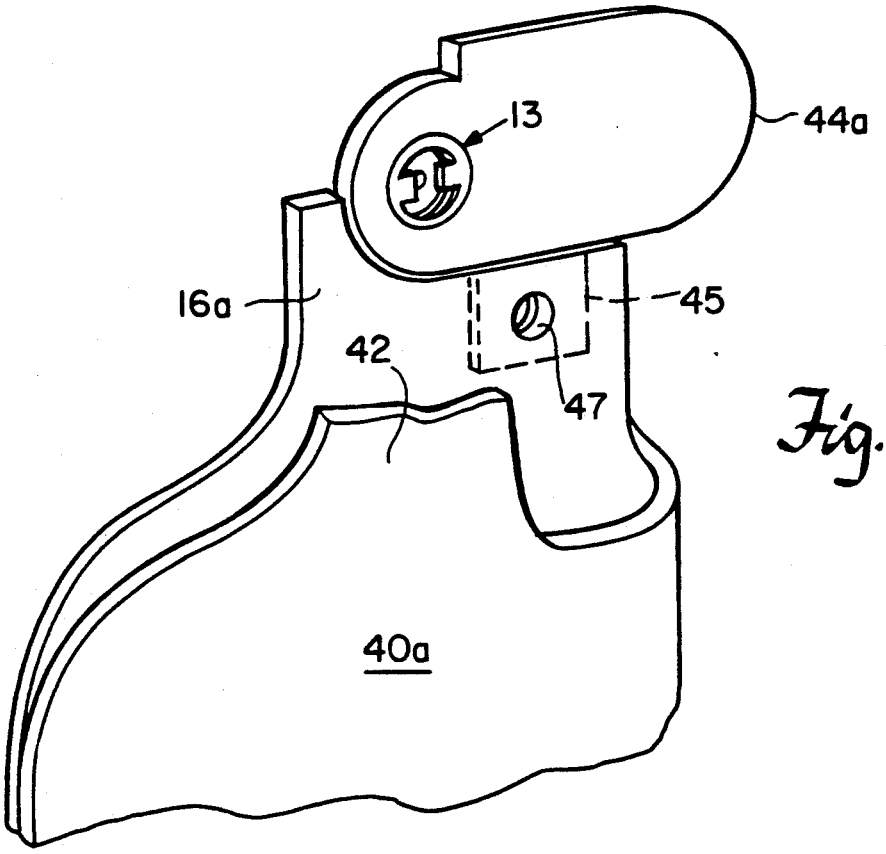
FIG. 1E is a partial schematic view of a means of locking the security thumb-break of FIG. 1A in the security position.

FIG. 1E illustrates a simple embodiment of the means of locking pivot member 44a in the double restraint or security position to prevent its movement back to the single security position shown in FIG. 1A. Such a locking feature would be especially useful when the holster is not being worn, for example when it is in an officer's storage locker. Preferably, such a locking device includes any of the known key operated or device operated locks which would allow them to be opened only by the officer possessing the key or device needed to unlock the lock. In the embodiment of FIG. 1E, pivot member 44a includes protruding section 45 which rests behind section 16a of holster 40a in the double security position shown. Portions 16a and 45 have hole 47 therethrough which are aligned in the position shown to allow a padlock or other locking device, not shown, to fit therethrough. Such a locking structure would prevent member 44a from pivoting back to the vertical, single security position and thus would prevent the handgun, not shown, from being removed from holster 40a. It should be understood that the invention encompasses the provision of any of the locking devices known in the art which may be built directly into the holster to accomplish the locking of pivot member 44a in the double security position. It is simply necessary to accomplish a locking device which is activated or locked only by some positive action taken by the wearer, for example by the use of a key or the addition of a padlock in the embodiment shown. The locking device thus prevents pivot member 44a from inadvertently locking when the wearer needed to withdraw the gun.

Figure 2:
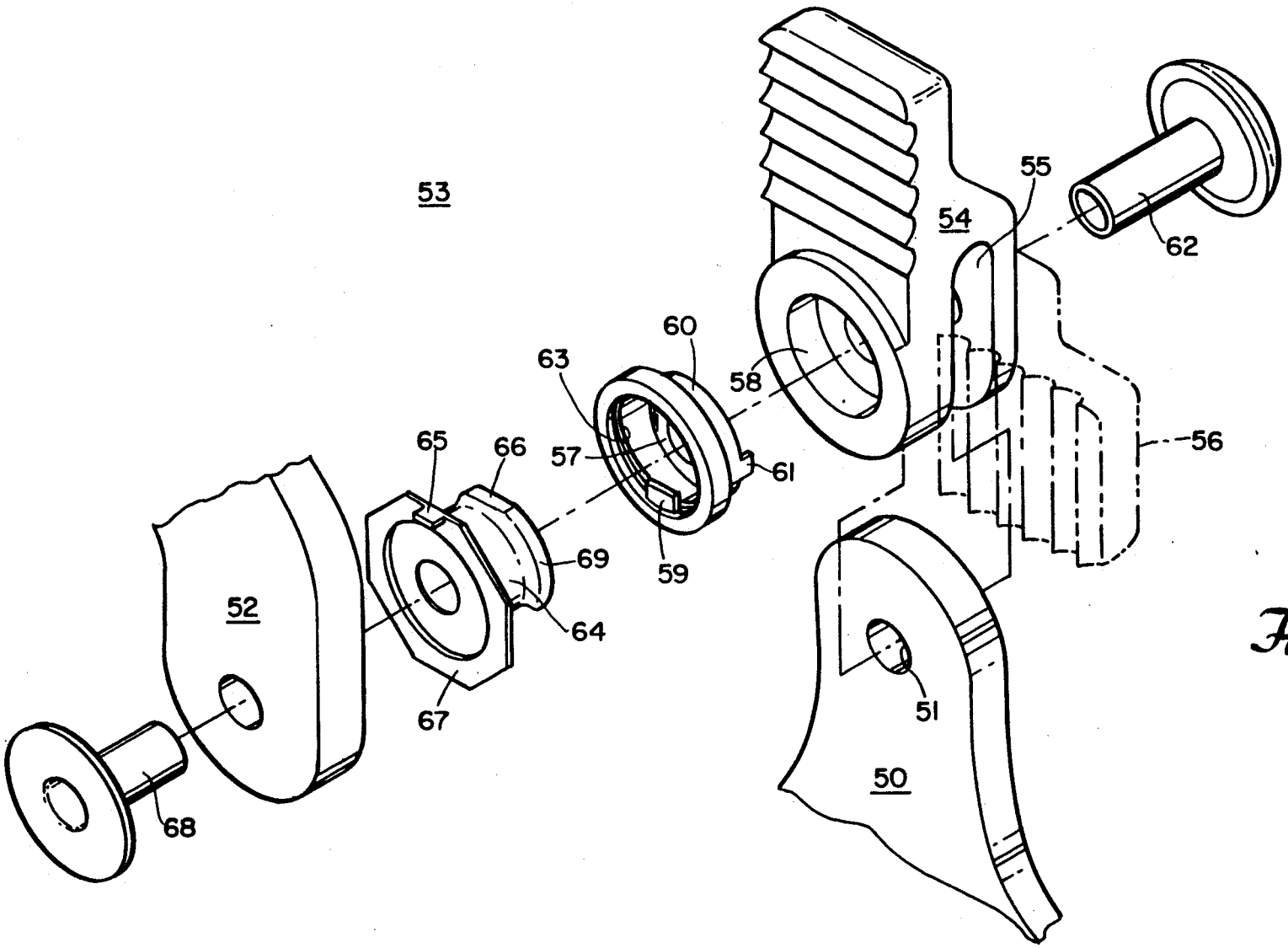
FIG. 2 is an exploded axonometric view of an alternative security thumb-break for a holster according to this invention.

FIG. 2 illustrates in detail thumb-break swivel security device 53 according to this invention, which may be used on a standard thumb-break in place of the standard snap assembly. Swivel member 54 may be made of metal or plastic, for example, and includes slot 55 sized to fit over thumb-break tab 50 of any thumb-break style holster. In typical thumb-break holsters, the snap assembly would fit through hole 51. Forward slot 55 allows member 59 to pivot forward up to 90° to security position 56, in phantom, more fully described below. The rear section of member 54 is not slotted, and rests against tab 50 in the ready position shown, to automatically align tabs 59 with flats 66, as described below.

Socket member 60 is fitted in hole 58 and includes tab key 61 which penetrates swivel member 54 to prevent socket 60 from rotating in hole 58. Button 62 passes through hole 58 and is peened over against base 57 to hold socket 60 in swivel 54 and also to hold swivel 54 on tab section 50. Likewise, eyelet 68 is employed to hold stud member 67 on holster safety strap 52. Member 67 includes tab key 65 for preventing rotation on strap 52. Protruding stud 64 has flats 66, only one shown, for decreasing the diameter of head 69 to allow protruding tabs 59, only one shown, in socket member 60 to engage behind head 69. When the snap is engaged and swivel member 54 pivoted to security position 56, shown in dashed line, tab members 59 lock behind the large lobes of head 69 to prevent the snap from being disengaged. In the ready position shown in FIG. 2, snap ring 63 retains stud 64 in socket 60.

It should be understood that the embodiment shown in FIG. 2, with the snap socket member on the protruding swivel member and having protruding tabs fitting over flats in the snap head, are not necessary limitations of this invention. Alternatively, in a device with a snap security device the snap socket member could be on the safety strap and could engage with the snap head member in a different manner.

Figure 3:
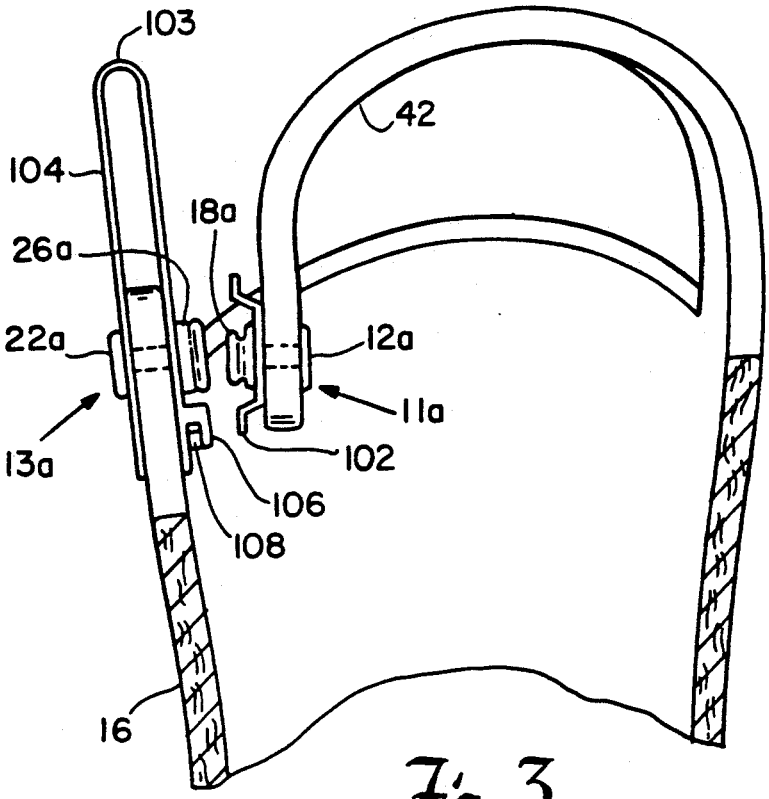
FIG. 3 is a view similar to FIG. 1B of an alternative security thumb-break according to this invention.

FIG. 3 depicts an alternative security thumb-break in which the primary level of security is provided by relatively rotatable engaging members 102 and 104. Preferably, engaging member 102 is fixed to safety strap 42 by snap member 11a including eyelet 12a and protruding stud 18a which is a normal round snap stud fitting into socket member 26a of snap member 13a, attached to holster 16 by eyelet 22a. Snap member 13a also holds rotatable thumb-break 104 to holster 16a while providing pivoting on the longitudinal axis of snap member 13a as described above in conjunction with FIGS. 1 and 2.

Rotating security device engaging member 104 includes protruding tongue members 106 and 108 for engaging the protruding tongues of fixed securing device 102 as is described with more particularity below. To help with the understanding of the operation of the security device, it should be understood that member 104 rotates on snap member 13a from the vertical position shown in FIG. 3 to a 90° rotated position in which, in the view shown in FIG. 3, the top 103 of member 104 would move toward the viewer.

Figure 4A:
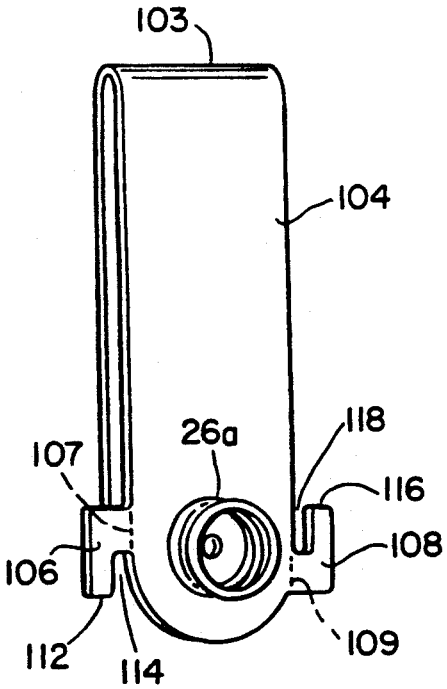
FIG. 4A is a front elevational view of the rotatable fastener of FIG. 3 showing the engaging members bent flat to more clearly illustrate those members.

The front side of member 104 facing security strap 42 is shown in more detail in FIG. 4A, in which protruding members 106 and 108 are shown flattened, co-planar with member 104, for ease of explanation. It should be understood that in use members 106 and 108 are bent along lines 107 and 109, respectively, 90° to the position shown in FIG. 3.

Protruding member 106 includes distal end 112 defining receiving slot 114 between members 106 and 104. Similarly, member 108 includes oppositely facing distal end 116 defining receiving slot 118 between it and member 104.

Figure 4B:
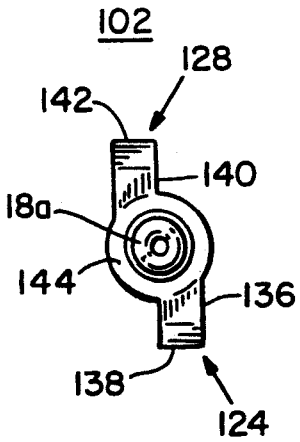
FIG. 4B is an elevational view of the safety strap securing device of FIG. 3.
Figure 4C:
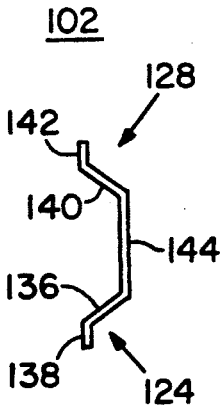
FIG. 4C is a side view of the fastener of FIG. 4B with the snap member removed for clarity.

Fixed securing device 102 is shown in more detail in FIGS. 4B and 4C, in which it can be seen that flat central body 144 is disposed against strap 42, FIG. 3, by snap member 11a with stud 18a.

Protruding tongues 124 and 128 include engaging portions 138 and 142 and protruding portions 136 and 140, respectively. As is explained below in conjunction with FIGS. 5A and 5B, engaging portions 138 and 142 engage with members 106 and 108, FIG. 4A, by fitting into slots 114 and 118 to prevent relative movement between strap 42 and holster 16 and keep snap members 11a and 13a engaged to provide an additional level of security in a thumb-break style holster.

Figure 5A:
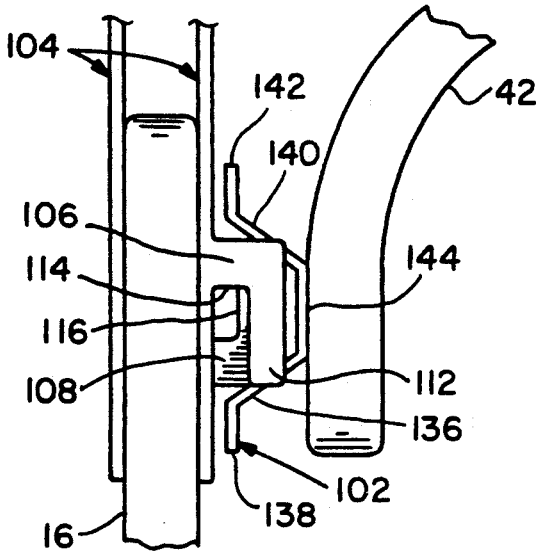
FIGS. 5A and 5B are enlarged views of securing means of the thumb-break of FIG. 3 in the open and secured positions, respectively, with the snap member removed for clarity.
Figure 5B:
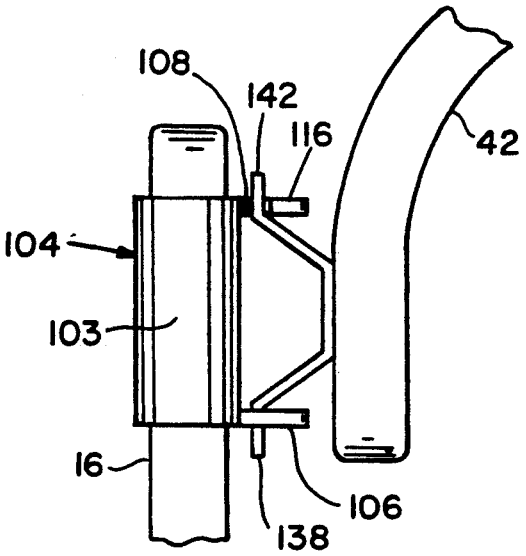

FIG. 5A depicts in enlarged detail the engaging portions of the security device of FIG. 3 with both portions of the snap removed for clarity. As can be seen, relatively rotatable security devices 102 and 104 in the unsecured position of FIG. 5A are not engaged. In the engaged position of FIG. 5B, member 104 is shown rotated into the security position with top 103 facing the viewer. As can be seen, engaging tongue 106 is rotated to engage engaging portion 138 and likewise portion 108 engages portion 142. Engaging portions 138 and 142 have a thickness less than the width of slots 114 and 118, shown in FIG. 4A, so that protruding distal ends 112 and 116 can pass over portions 138 and 142, respectively to effectively interlock the engaging portions to prevent relative movement between strap 42 and holster 16.

Figure 6A:
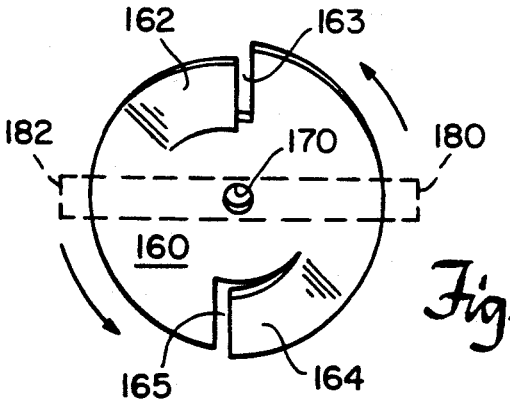
FIG. 6A is an elevational view of the receiving part of another alternative security thumb-break according to this invention with the functional part of the rotating member shown in phantom.
Figure 6B:
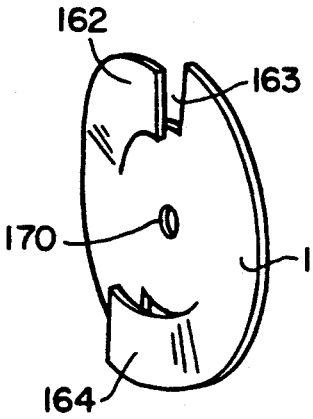
FIG. 6B is an axonometric view of the fastener member of FIG. 6A.
Figure 6C:
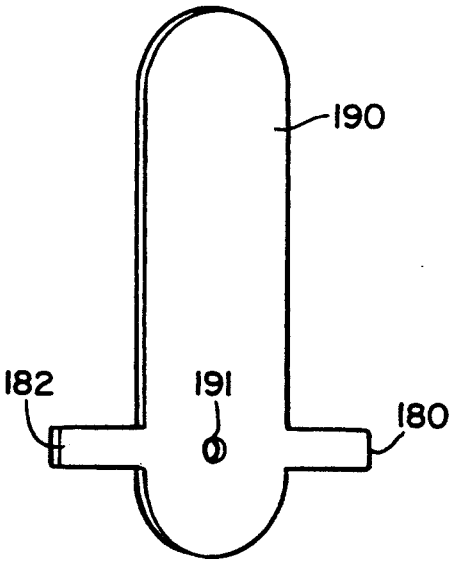
FIG. 6C is a elevational view of one form of the rotatable fastener of the embodiment of FIG. 6A.

An alternative to the security device depicted in FIGS. 3 through 5 is shown in FIGS. 6A through 6C. Fixed member 160 replaces member 102 and is a disc-shaped member having protruding members 162 and 164 formed by cutting radial and arc shaped slots 163 and 165, and then bending portions 162 and 164. Central hole 170 is provided for attachment to the safety strap or holster as desired. Rotatable security device with engaging ends 180 and 182 shown in phantom in FIG. 6A may be rotated in the direction of the arrow as shown to provide engagement under protruding portions 162 and 164 to interlock the devices.

Protruding members 180 and 182 may be accomplished as depicted in FIG. 6C in which rotatable member 190, including hole 191 for providing attachment and a rotation axis, includes protruding members 180 and 182 relatively rotatable from the position shown in FIG. 6A to a rotated position up to 90° therefrom to engage portions 180 and 182 under protruding members 162 and 164. It should be understood that either member 160 or 190 may be rotatable and either may be attached to the strap or the holster as desired to provide the rotating engagement and disengagement as the first level of security in a thumb-break style holster.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An assembly for releasably securing at two spaced locations a holster safety strap to a holster, comprising:

a fastener assembly on the holster and safety strap operable in a first direction adapted to releasably engage to provisionally attach the strap to the holster;

at least one rigid tongue member protruding from one of the strap and holster, facing the other of the strap and holster when said fastener assembly is engaged; and at least one tongue member receiving means attached to the other of the strap and holster and facing said rigid tongue member when said fastener assembly is engaged, said tongue member receiving means and said tongue member being relatively rotatable when engaged, in a second direction from a first, unlocking position wherein said tongue member is not engaged with said tongue member receiving means, to a second, securing position wherein said tongue member is engaged with said tongue member receiving means to prevent operation of said fastener assembly when engaged from disengaging for providing additional securing in a holster safety strap.

2. The assembly of claim 1 in which said tongue member is attached to the strap.

3. The assembly of claim 1 in which said tongue member receiving means is attached to the strap.

4. The assembly of claim 1 in which said tongue member is attached to the holster.

5. The assembly of claim 1 in which said tongue member receiving means is attached to the holster.

6. The assembly of claim 4 in which said tongue member rotates about an axis transverse to the holster.

7. The assembly of claim 5 in which said tongue member receiving means rotates about an axis transverse to the holster.

8. The assembly of claim 1 in which said fastener assembly includes a snap assembly with a protruding stud with an enlarged head adapted to engage a stud-receiving socket member.

9. The assembly of claim 8 in which said stud is attached to the strap and said socket member is attached to the holster.

10. The assembly of claim 8 in which said stud is attached to the holster and said socket member is attached to the strap.

11. The assembly of claim 8 in which said socket member includes at least one protruding tab for inhibiting disengagement of said stud from said socket member.

12. The assembly of claim 1 in which said tongue member includes a locking means for releasably securing the tongue member to the holster when the tongue member is in the securing position.

13. The assembly of claim 1 in which said tongue member receiving means includes a locking means for releasably securing the tongue member receiving means to the holster when the tongue member receiving means is in the securing position.

* * * * *